US006721431B1

(12) United States Patent
Johnson

(10) Patent No.: US 6,721,431 B1
(45) Date of Patent: Apr. 13, 2004

(54) PRISMATIC LOUDSPEAKER/MICROPHONE ARRAY

(76) Inventor: Dean E Johnson, Room 103, Extended Stay of America #780, 27775 Stansbury Farmington, MI (US) 48334

( * ) Notice: Subject to any disclaimer, the term of this patent is extended or adjusted under 35 U.S.C. 154(b) by 0 days.

(21) Appl. No.: 09/490,946

(22) Filed: Jan. 24, 2000

(51) Int. Cl.[7] ..... H04R 9/08

(52) U.S. Cl. ..... 381/336; 381/182; 381/186; 381/388; 181/199; 181/144

(58) Field of Search ..... 381/336, 98, 89, 381/182, 186, 386, 335; 181/144, 145, 147, 199

(56) References Cited

U.S. PATENT DOCUMENTS 5,436,976 A * 7/1995 Dougherty ..... 381/390

* cited by examiner

*Primary Examiner*—Minsun Oh Harvey
(74) *Attorney, Agent, or Firm*—Michael I. Kroll

(57) ABSTRACT

An audio array for receiving or generating audio signals. The audio array includes first, second and third audio elements and first second and third structures. Each of the first second and third structures are right triangles. The first second and third audio elements are each secured to a respective one of the first, second and third structures and the first, second and third structures are positioned to extend at a substantially 90° angle to each other. The first second and third audio elements are positioned in a substantially central location of the first second and third structures. The first second and third audio elements are all either speakers or microphones. The first, second and third structures are all retained within a comprising a housing.

6 Claims, 8 Drawing Sheets

PRISMATIC LOUDSPEAKER/MICROPHONE ARRAY

BACKGROUND OF THE INVENTION

1. Field of the Invention

The present invention relates generally to microphones and loudspeakers and, more specifically, to a speaker/microphone array able to provide a uniform response, maintaining a constant Q with rising frequencies and microphone elements arranged in an annular 90°—90°—90° prismatic array to give a substantially 9 dB forward gain without lobing or frequency drop offs within the 90°—90°—90° pattern.

2. Description of the Prior Art

Numerous types of loudspeakers and microphones have been provided in the prior art. For example, U.S. Pat. Nos. 3,165,587; 4,618,025; 4,635,748; 4,714,133; 5,123,500; 5,324,896; 5,502,772 and 5,514,841 all are illustrative of such prior art. While these units may be suitable for the particular purpose to which they address, they would not be as suitable for the purposes of the present invention as heretofore described.

This invention relates generally to audio reproduction techniques, and more specifically to an integrated, multiple speaker acoustic system whose enclosed units smoothly cover complementary frequency ranges without cross interference therebetween.

In an acoustical speaker having a movable diaphragm responsive over a range of frequencies, an air duct having a cross-sectional area less than that of the diaphragm substantially surrounding the diaphragm and in communication with one side thereof for acoustically isolating the diaphragm, dampening low-frequency ringing and acoustically loading the diaphragm for extending the frequency range to lower frequencies to enhance the performance of the speaker with small speaker enclosures. One embodiment provides for similar ducting for passive radiator diaphragms.

A speaker cabinet of the type used in stereo systems. A horizontal wall partitions the interior of the cabinet into an upper portion within which is positioned a full range speaker member, and a lower portion within which is positioned a low range speaker member. A pair of laterally spaced ports are formed in the partition wall to allow sound emanating from the low range speakers is spaced apart therefrom, in non-attached relation thereto to define a space between the full range speaker and the horn. Sound from the low range speaker and from the full range speaker enters into the space between the full range speaker and the horn and mixes so that the sound emanating from the horn is a full-bodied sound characterized by minimal distortion and substantial absence of unpleasant sounds of the type associated with speakers of the prior art.

The invention presents a method for improving overall efficiency and quality in sound reproduction systems by providing a system which establishes positive phase control over the many and varied resonant characteristics encountered in the reproduction and presentation of audio energy. The apparatus embodying the present method primarily consists of speaker structures within which drivers such as conventional cone drivers are acoustically coupled to both air and to the materials from which the enclosure of the speaker structure is formed by optimizing existing atmospheric pressure differentials and induced audio vibration readily available within these structures. The coupling is obtained through the use of acoustical resonator structure placed within a speaker enclosure and through particular distribution of mass in the enclosure and in the materials.

A loudspeaker enclosure is formed generally in the shape of a tetrahedron, having a triangular bottom panel and three upstanding triangular side panels. In a first embodiment, the lower edges of the three side panels are connected to the three edges of the bottom panel, and the upstanding edges of the side panels are connected together. One or more speakers are mounted in respective apertures formed through the front side panel of the enclosure such that the sound waves generated thereby are directed forwardly therefrom. Another speaker is supported within the enclosure facing generally downwardly, but is angled toward the front side panel of the enclosure. The sound waves generated by the downwardly facing speaker are emitted through an opening formed through the lower end of the front side panel. In a second embodiment, the side panels of the enclosure are connected together as above, but are supported above the bottom panel of the enclosure by a plurality of legs so as to define an open space extending about the bottom panel. The downwardly facing speaker faces directly downwardly toward the bottom panel, and the sound waves generated thereby are emitted through the open space around the enclosure.

An audio loudspeaker system is provided which consists of an enclosure having a front wall, a rear wall with a plurality of circular openings, a pair of side walls, a top wall and a bottom wall. A plurality of loudspeaker components are supported on the front wall of the enclosure for radiating sound energy therethrough and having varying frequency ranges. A plurality of tubular ducts are supported in the circular openings in the rear wall and extend inwardly into the enclosure to exhibit a tuned acoustic frequency to the loudspeaker components having the lowers frequency ranges.

A multi-dimentional speaker system having a specifically configured arrangement comprising, tweeters, mid-range, sub-woofer, woofer, air baffles and spacers to enhance sound reproduction.

The present invention relates to a reflex compression valve-divided chamber speaker cabinet which improves acoustic frequencies emanating from the speaker cabinet by specially designed and positioned ports located frontally and rearwardly within the speaker cabinet. The speaker cabinet greatly reduces reverb or lag caused by uncontrolled reflecting air within a standard baffle chamber resulting from the speaker cabinet design and electrical passive crossover network.

SUMMARY OF THE PRESENT INVENTION

The present invention relates generally to microphones and loudspeakers and, more specifically, to a speaker microphone array able to provide a uniform response, maintaining a constant Q with rising frequencies and microphone elements arranged to give a similar response throughout the 90°—90°—90° pattern.

A primary object of the present invention is to provide an audio speaker/microphone array that will overcome the shortcomings of prior art devices, e.g. rising Q with frequency and varying frequency response with angle.

Another object of the present invention is to provide an audio speaker/microphone array which is able to provide a uniform response with increasing audio signal frequencies.

A further object of the present invention is to provide an audio speaker/microphone array which is able to eliminate lobing and beaming of frequencies.

A yet further object of the present invention is to provide an audio each other.

A still further object of the present invention is to provide an audio speaker/microphone array including three speakers or microphones in a 90°—90°—90° array provide same frequency response at all points within the radiation reception pattern of the cluster.

A further object of the present invention is to provide an audio speaker/microphone array wherein the relationship between the speakers/microphone elements minimizes the directional effects of the speakers/microphone elements at a wide range of frequencies.

An even further object of the present invention is to provide an audio speaker/microphone array wherein the clustering of the microphone elements in a 90°—90°—90° array provides a Q of 8.

A yet further object of the present invention is to provide an audio speaker/microphone array wherein the clustering of the microphone elements are in a prismatic array such as in a transmitter or receiver antenna.

A still further object of the present invention is to provide an audio speaker/microphone array wherein the microphone clustering provides a 9 dB forward gain over a single microphone with no lobing or frequency drop offs within the 90°—90°—90° reception pattern.

Another object of the present invention is to provide an audio speaker/microphone array that is simple and easy to use.

A still further object of the present invention is to provide an audio speaker/microphone array that is economical in cost to manufacture.

Additional objects of the present invention will appear as the description proceeds.

An audio array for receiving or generating audio signals is disclosed by the present invention. The audio array includes first, second and third audio elements and first second and third structures. Each of the first second and third structures are right triangles. The first second and third audio elements are each secured to a respective one of the first, second and third structures and the first, second and third structures are positioned to extend at a substantially 90° angle to each other. The first second and third audio elements are positioned in a substantially central location of the first second and third structures. The first second and third audio elements are all either speakers or microphones. The first, second and third structures are all retained within a comprising a housing.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
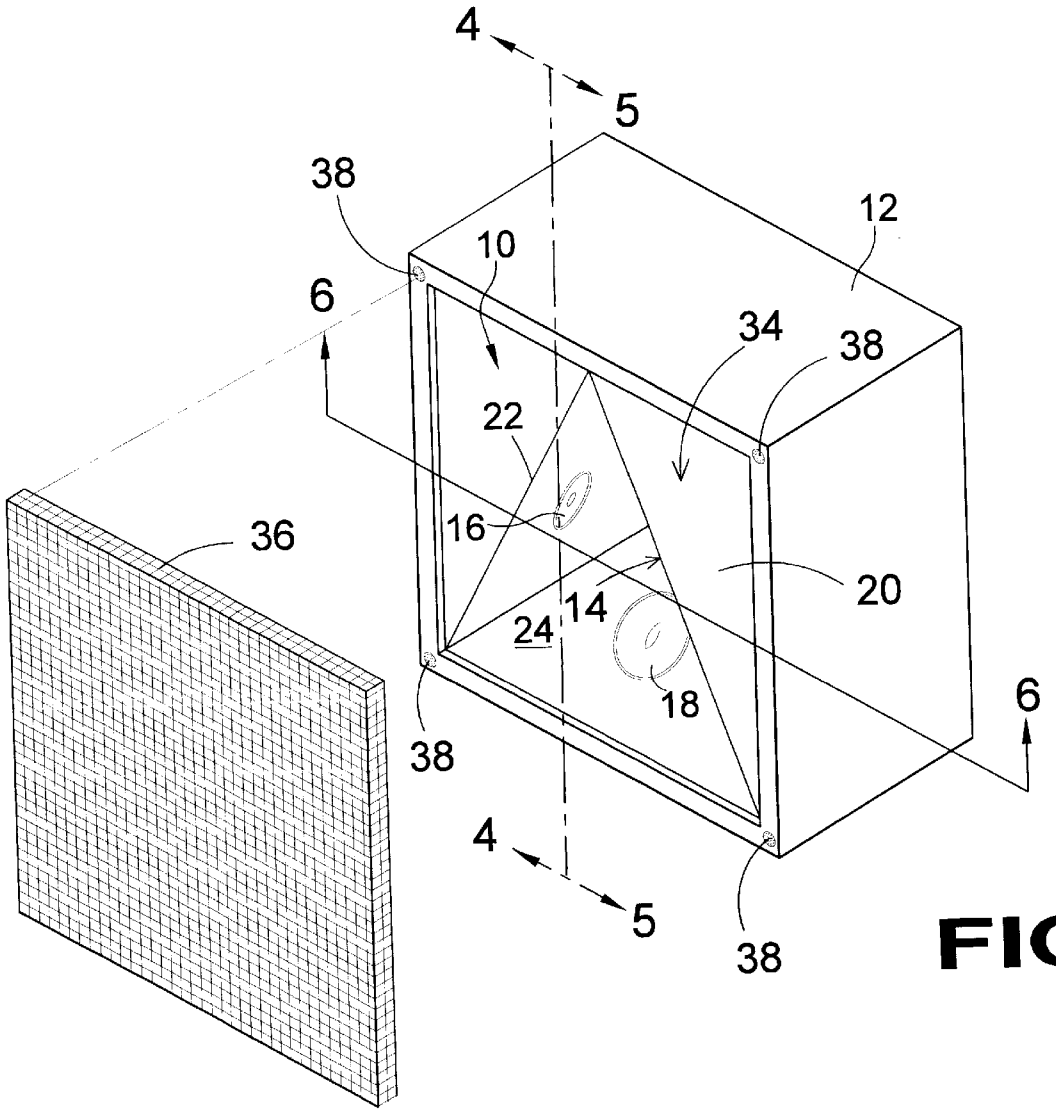
FIG. 1 is a front view of the audio speaker/microphone array of the present invention contained within a speaker cabinet.

Turning now descriptively to the drawings, in which similar reference characters denote similar elements throughout the several views, the Figures illustrate the audio speaker/microphone array of the present invention. With regard to the reference numerals used, the following numbering is used throughout the various drawing figures.

10 audio speaker array of the present invention
12 speaker cabinet housing audio speaker/microphone array
14 first speaker of audio speaker/microphone array
16 second speaker of audio speaker/microphone array
18 third speaker of audio speaker/microphone array
20 structure for maintaining first speaker in position
22 structure for maintaining second speaker in position
24 structure for maintaining third speaker in position
26 right angle between structures for second and third speakers
28 right angle between structures for first and third speakers
30 right angle between structures for first and second speakers
32 point at which first, second and third structures meet
33 right angle of the first structure
34 open side of the cabinet
35 right angle of the second structure
36 cover
37 right angle of the third structure
38 retaining clips
40 front side of speaker cabinet
50 microphone array of the present invention
52 microphone
54 first microphone element
56 second microphone element
58 third microphone element
60 first structure
62 second structure
64 third structure
66 common point between the first, second and third structures
68 open side of the microphone
70 90° angle between adjacent structures in microphone
72 wire leading from microphone elements
74 adapter for connecting microphone elements to an amplifier

76 stand for microphone
78 handle for microphone

DETAILED DESCRIPTION OF THE PREFERRED EMBODIMENT

Figure 7:
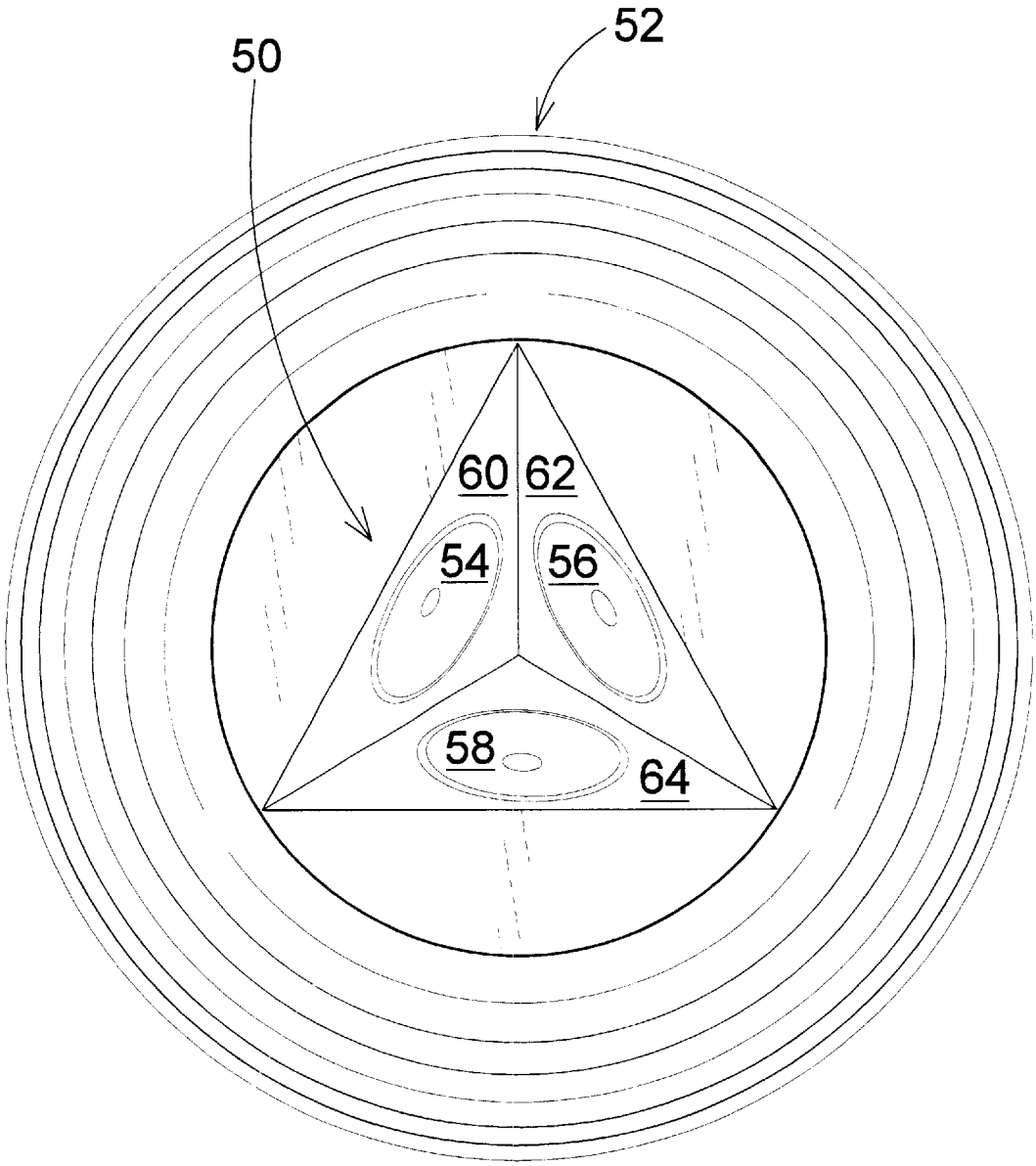
FIG. 7 is a top side view of the audio speaker/microphone array of the present invention used in a microphone showing the position of microphone elements.
Figure 8:
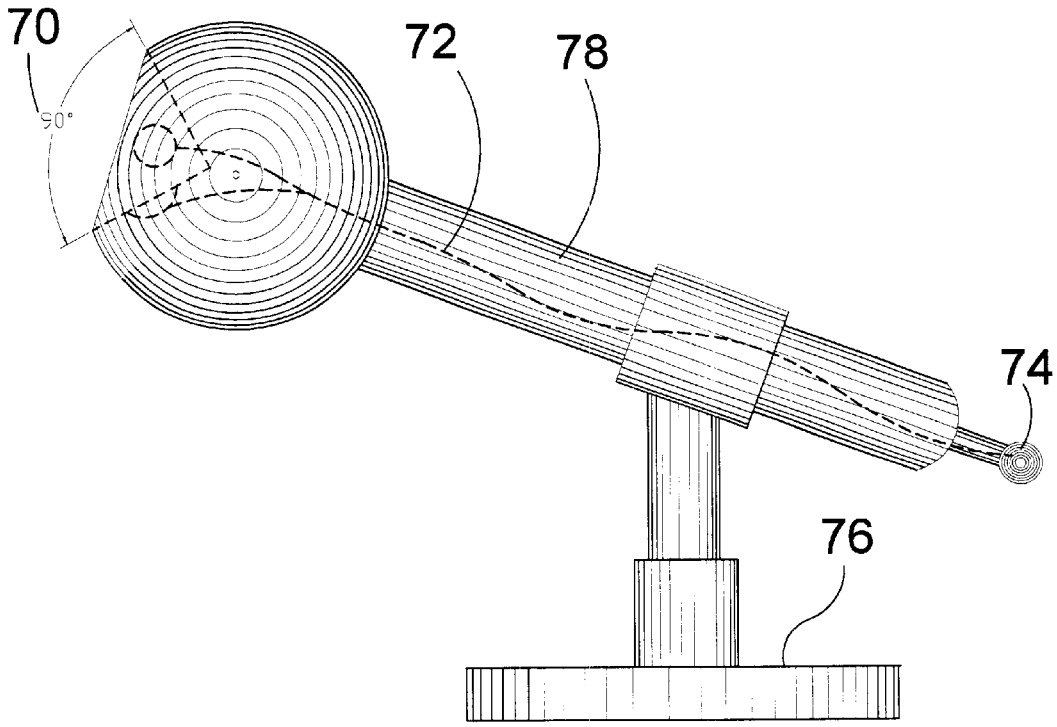
FIG. 8 is a side perspective view of a microphone including the audio speaker/microphone array of the present invention.

Turning now descriptively to the drawings, in which similar reference characters denote similar elements throughout the several views, FIGS. 1 through 6 illustrate the audio speaker array of the present invention indicated generally by the numeral 10. FIGS. 7 and 8 illustrate the array of the present invention is illustrated with audio microphones indicated generally by the numeral 50.

The audio speaker array 10 is illustrated in FIG. 1 within a speaker cabinet 12. The audio speaker array 10 includes a first speaker element 14, a second speaker element 16 and a third speaker element 18. The first speaker element 14 is maintained in position within the speaker cabinet 12 by a first structure 20. The second speaker element 16 is maintained in position within the speaker cabinet 12 by a second structure 22. The third speaker element 18 is maintained in position within the speaker cabinet 12 by a third structure 24. The first, second and third structures 20, 22 and 24, respectively, are preferably triangular in shape and even more preferably right triangles.

A first leg of the first structure 20 is positioned adjacent and in mating relation with a first leg of the second structure 22. The first and second structures 20 and 22 preferably extend perpendicular to each other. A second leg of the first structure 20 is positioned adjacent and in mating relation with a first leg of the third structure 24. The first and third structures 20 and 24 also preferably extend perpendicular to each other. A second leg of the second structure 22 is positioned adjacent and in mating relation with a second leg of the third structure 24. The second and third structures 22 and 24 also preferably extend perpendicular to each other. The first, second and third structures 20, 22 and 24 have a prismatic relationship whereby each structure extends along a respective one of the x, y and z planes. The first, second and third structures 20, 22 and 24 all meet at a common point 32 forming three sides of a pyramid. The common point is at the right angle of each of the first, second and third structures 20, 22 and 24. The first, second and third structures 20, 22 and 24 are positioned within the speaker cabinet 12 facing an open side 34 of the cabinet 12. A cover 36 is positioned over the open side 34 of the cabinet 12. The cover 36 is releasably connected to the cabinet 12 by retaining clips 38.

Figure 2:
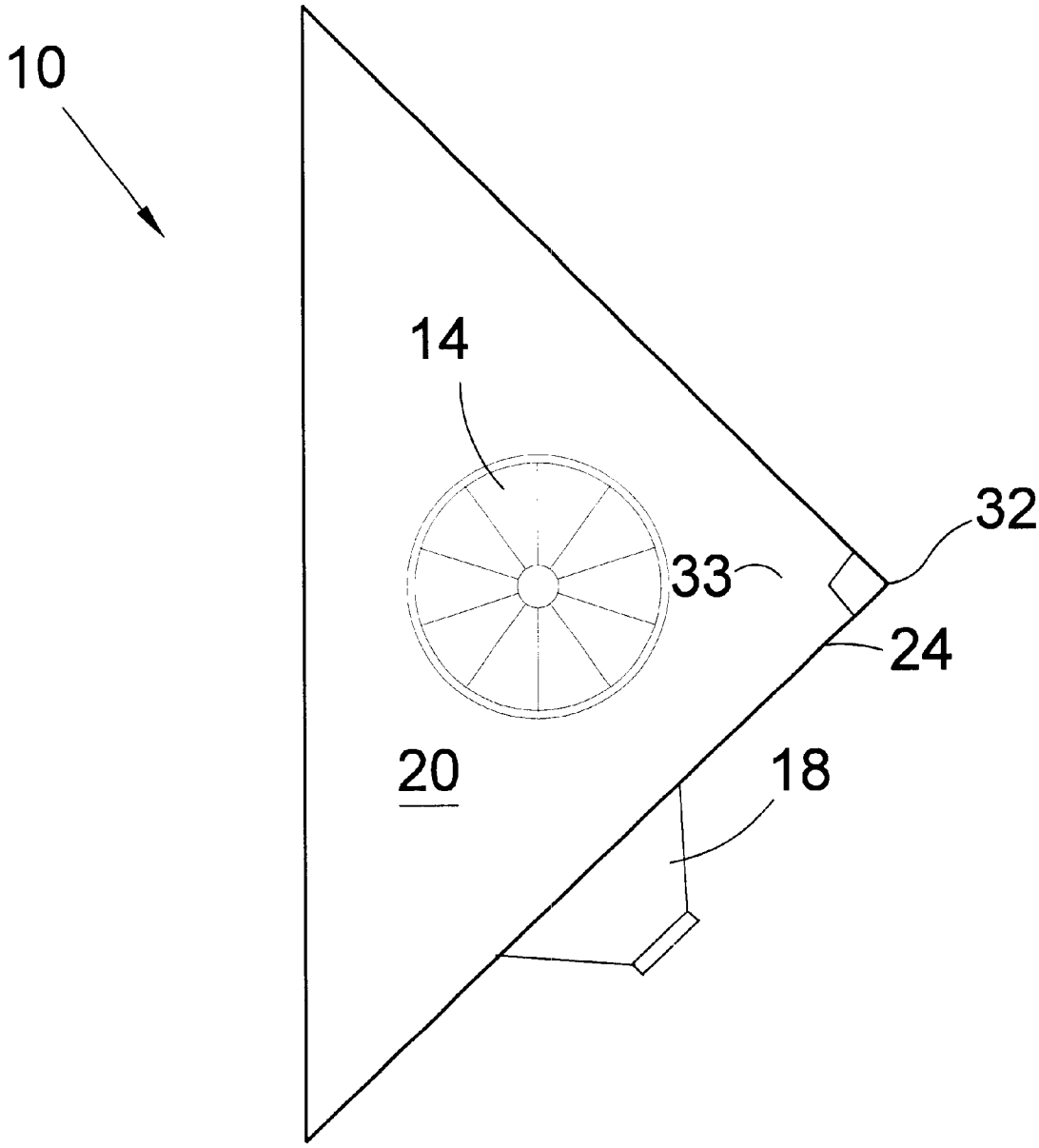
FIG. 2 is side perspective view of the audio speaker/microphone array of the present invention outside of the speaker cabinet.

A right side view of the speaker array 10 is illustrated in FIG. 2. From this view, the first speaker element 14 is shown centrally positioned in the first structure 20. Positioned at a 90° angle to the first structure 20 is the third structure 24 and the third speaker element 18 extends from the third structure 18 on a side opposite the first structure 20. The right angle 33 of the first structure 20 is positioned to contact the right angle of the third structure 24 at the meeting point 32.

Figure 3:
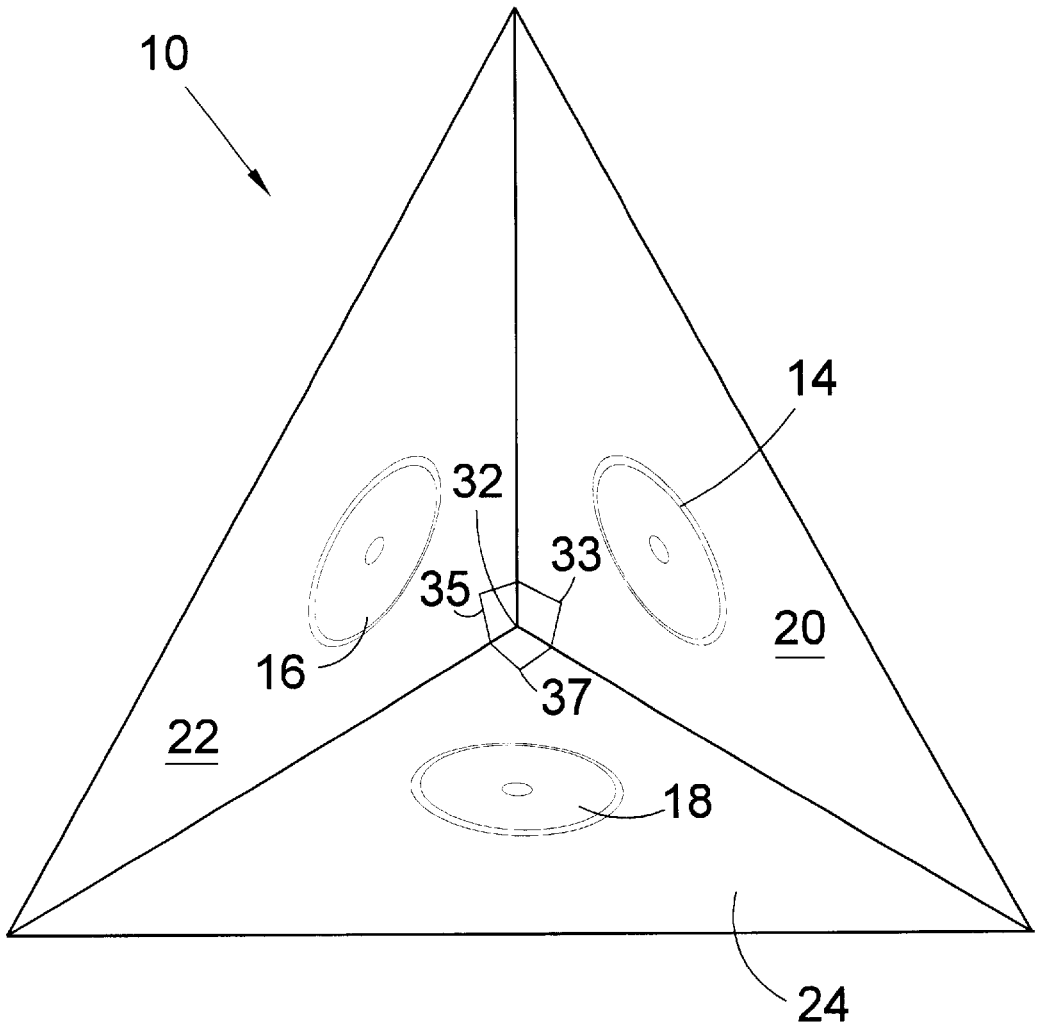
FIG. 3 is a back view of the audio speaker/microphone array of the present invention showing all three speakers of the array.

A front view of the speaker array 10 is shown in FIG. 3. As can be seen from this figure, the right angle 33 of the first structure 20, the right angle 35 of the second structure 22 and the right angle 37 of the third structure 24 all meet at the point 32. The first leg of the first structure 20 is positioned adjacent and in mating relation with the first leg of the second structure 22. The first and second structures 20 and 22 preferably extend perpendicular to each other. The second leg of the first structure 20 is positioned adjacent and in mating relation with the first leg of the third structure 24. The first and third structures 20 and 24 also preferably extend perpendicular to each other. The second leg of the second structure 22 is positioned adjacent and in mating relation with the second leg of the third structure 24. The second and third structures 22 and 24 also preferably extend perpendicular to each other. The first, second and third structures 20, 22 and 24 have a prismatic relationship. The first speaker element 14 is substantially centrally positioned in the first structure 20. The second speaker element 16 is substantially centrally positioned in the second structure 22. The third speaker element 18 is substantially centrally positioned in the third structure 24.

Figure 4:
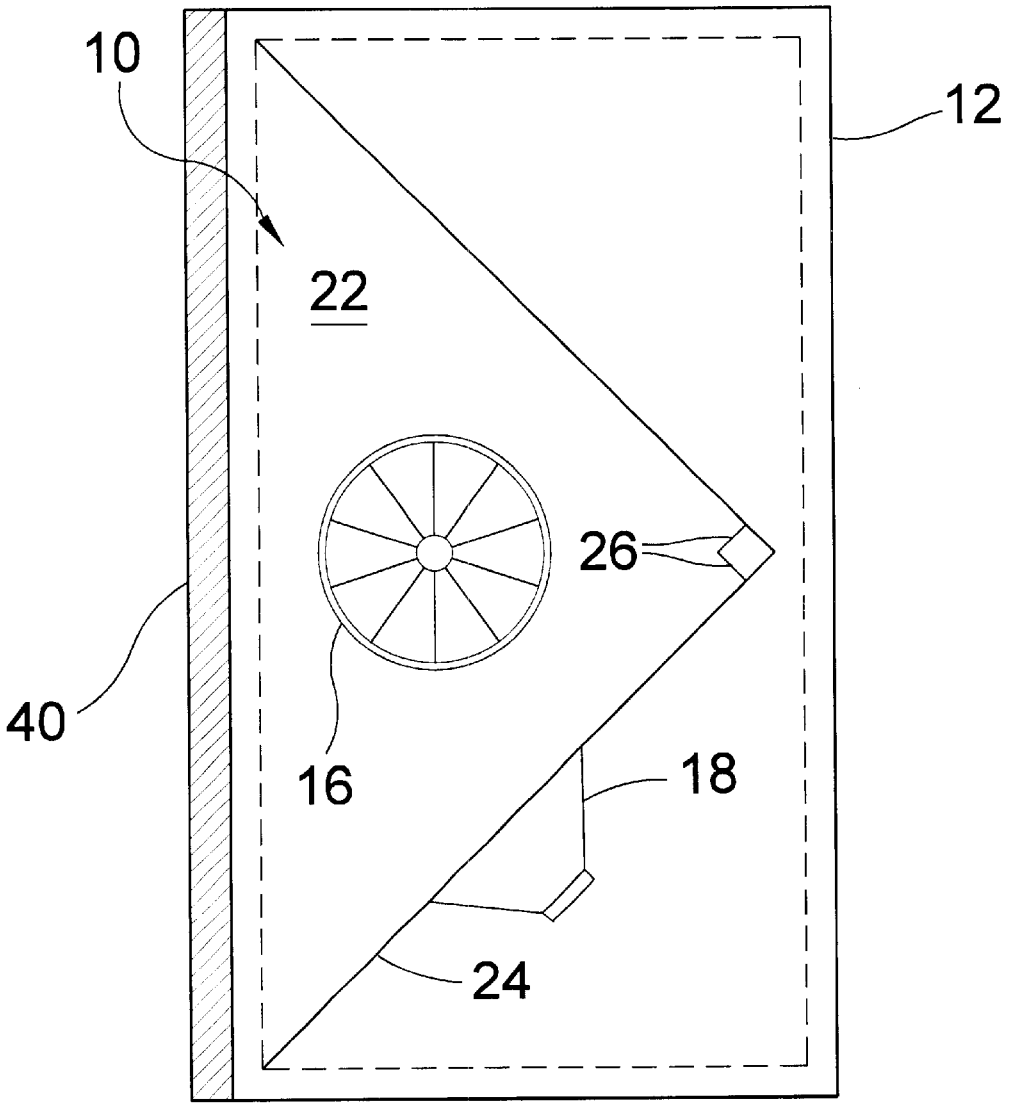
FIG. 4 is a cross-sectional view of the audio speaker/microphone array of the present invention taken along the line 4—4 of FIG. 1.

A cross-sectional view of the speaker array 10 taken along the connection between the first and second structures 20 and 22 and facing the second structure 22 is illustrated in FIG. 4. As can be seen the second and third structures 22 and 24 form a right angle 26 therebetween. The hypotenuse of the second and third structures 22 and 24 are positioned against a front side 40 of the speaker cabinet 12 and the structures extend back from the front side 40 into the speaker cabinet 12. The second speaker element 16 is shown substantially positioned on the second structure 22.

Figure 5:
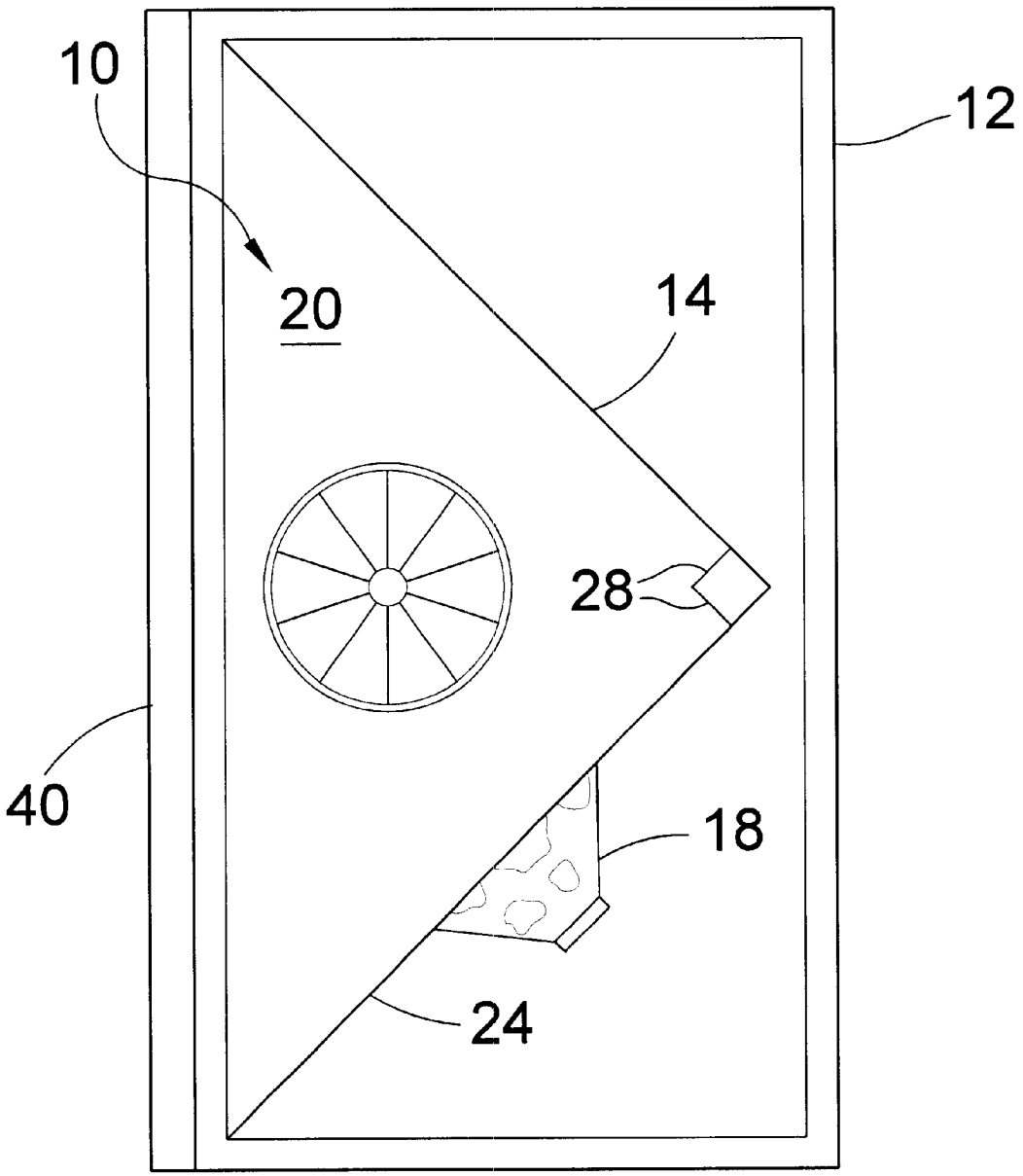
FIG. 5 is a cross-sectional view of the audio speaker/microphone array of the present invention taken along the line 5—5 of FIG. 1.

A cross-sectional view of the speaker array 10 taken along the connection between the first and second structures 20 and 22 and facing the first structure 20 is illustrated in FIG. 5. As can be seen the first and third structures 20 and 24 form a right angle 28 therebetween. The hypotenuse of the first and third structures 20 and 24 are positioned against the front side 40 of the speaker cabinet 12 and the structures extend back from the front side 40 into the speaker cabinet 12. The first speaker element 14 is shown substantially positioned on the first structure 20.

Figure 6:
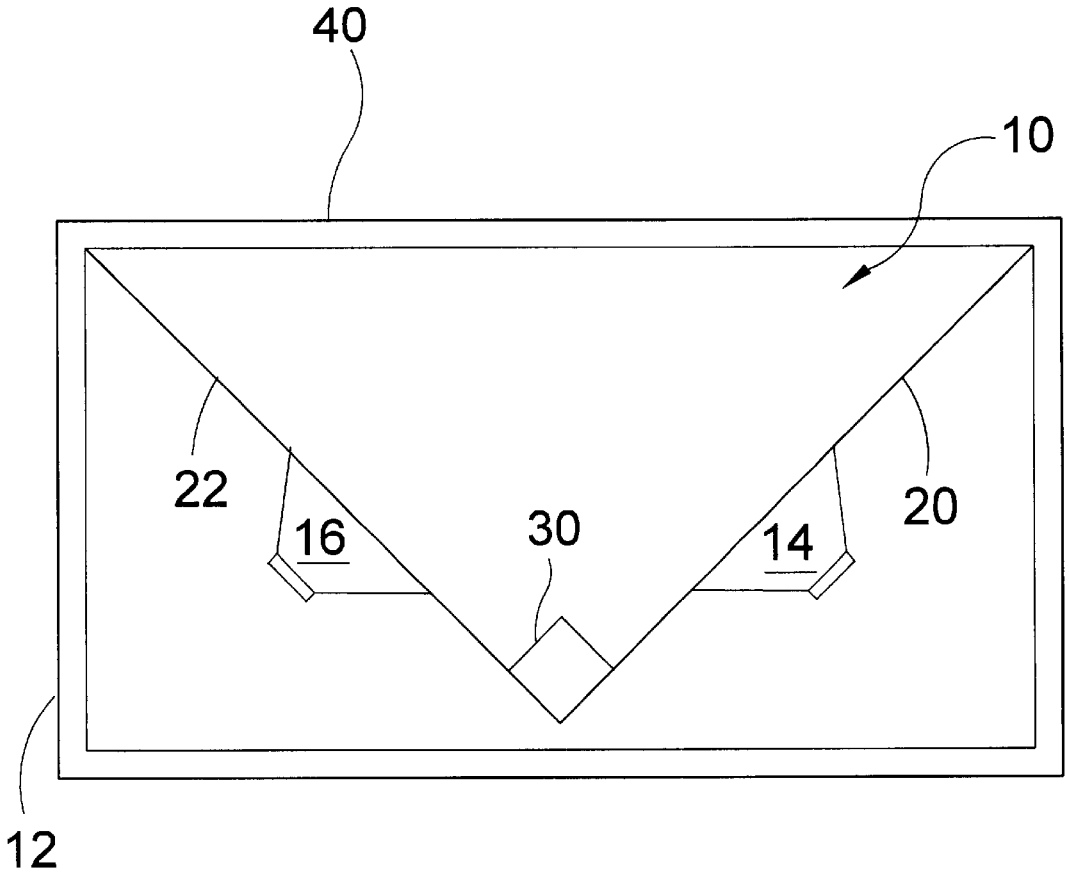
FIG. 6 is a cross-sectional view of the audio speaker/microphone array of the present invention taken along the line 6—6 of FIG. 1.

A top view of the speaker array 10 with a top side of the cabinet 12 removed is illustrated in FIG. 6. As can be seen from this figure, the first and second structures 20 and 22 form a right angle 30 therebetween. The hypotenuse of the first and second structures 20 and 22 are positioned against the front side 40 of the speaker cabinet 12 and the structures extend back from the front side 40 into the speaker cabinet 12.

The present invention is illustrated as a microphone array 50 in FIG. 7. A front view of the microphone 52 is shown with the microphone array 50 positioned substantially centrally therein. As can be seen, the audio microphone array 50 includes a first microphone element 54, a second microphone element 56 and a third microphone element 58. The first microphone element 54 is maintained in position within the microphone 52 by a first structure 60. The second microphone element 56 is maintained in position within the microphone 52 by a second structure 62. The third microphone element 58 is maintained in position within the microphone 52 by a third structure 64. The first, second and third structures 60, 62 and 64, respectively, are preferably triangular in shape and even more preferably right triangles.

A first leg of the first structure 60 is positioned adjacent and in mating relation with a first leg of the second structure 62. The first and second structures 60 and 62 preferably extend perpendicular to each other. A second leg of the first structure 60 is positioned adjacent and in mating relation with a first leg of the third structure 64. The first and third structures 60 and 64 also preferably extend perpendicular to each other. A second leg of the second structure 62 is positioned adjacent and in mating relation with a second leg of the third structure 64. The second and third structures 62 and 64 also preferably extend perpendicular to each other. The first, second and third structures 60, 62 and 64 have a prismatic relationship whereby each structure extends along a respective one of the x, y and z planes. The first, second and third structures 60, 62 and 64 all meet at a common point 66 forming three sides of a pyramid. The common point is at the right angle of each of the first, second and third structures 50, 62 and 64. The first, second and third structures 60, 62 and 64 are positioned within the microphone 52 facing an open side 68 of the microphone 52.

A microphone 52 is illustrated in FIG. 8 including the microphone array 50 of the present invention. As can be seen from the figure, the microphone array 50 is positioned in the microphone at a substantially central location. The 90° angle between the structures is indicated by the numeral 70. Extending from each of the microphone elements is a wire 72 for connection to an amplifier through an adapter 74. A handle 78 extends from a bottom side of the microphone 52 and the wires extend therethrough. The microphone 52 is maintained in position by a stand 76 which releasably grasps the handle 78.

The audio array 10, 50 of the present invention works as does any conventional speaker or microphone, the results are improved due to the arrangement of the speaker and microphone elements. The arrangement of the speaker or microphone elements in the 90°—90°—90° array provides a uniform response with increasing frequencies and eliminates lobing and beaming of frequencies.

From the above description it can be seen that the audio speaker/microphone array of the present invention is able to overcome the shortcomings of prior art devices by providing an audio speaker/microphone array which is able to provide a uniform response with increasing audio signal frequencies and eliminate lobing and beaming of frequencies. The audio speaker/microphone array includes speakers or microphones which form the array arranged at 90° to each other thereby providing the same frequency response at all points within the radiation reception pattern of the cluster, the cluster being a prismatic array such as in a transmitter or receiver antenna. The relationship between the speaker/microphone elements in the array minimizes the directional effects of the speaker/microphone elements at a wide range of frequencies and clustering of the microphone elements in the 90°—90°—90° array provides a Q of 8 and a 9 dB forward gain over a single microphone with no lobing or frequency drop offs within the 90°—90°—90° reception pattern. Furthermore, the audio speaker/microphone array of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An audio speaker/microphone array comprising:

a) a first flat member in the shape of a right triangle;

b) a second flat member in the shape of a right triangle, said second flat member being at right angles to said first flat member with a leg of each member being in mating relationship to each other;

c) a third flat member in the shape of a right triangle, said third flat member being at right angles to both of said first and second flat members with legs of the third flat member being in mating relationship with legs of said first and second flat members so that there is formed a partial enclosure with the right angle comer of each triangle being concurrent with each other;

d) an opening centrally positioned within each of said flat members; and d) a speaker/microphone element mounted through a said opening in each of said flat members, each speaker/microphone element being mounted on an outside of the flat member with the speaker/microphone element directed into said partial enclosure.

2. The audio speaker/microphone array of claim 1 in which said array in mounted inside of a housing, said housing having an open face side and said partial enclosure faces said open face side.

3. The audio speaker/microphone array of claim 1 in which said array consists of all microphones.

4. The audio speaker/microphone array of claim 1 in which said array consists of all speakers.

5. The audio speaker/microphone array of claim 2 in which said housing is a speaker cabinet, the array consists of speakers, and each flat member has a hypotenuse and the hypotenuse of the second and third flat members are positioned against a front side of said cabinet and extend back from the front side of said cabinet.

6. The audio speaker/microphone array of claim 3 in which said array is positioned within a microphone enclosure mounted on an end of a handle, wires to said array extending out through an opposite end of said handle, and a stand for releasably supporting said handle and microphone array, said enclosure having an opening and said partial enclosure facing said opening.

* * * * *